US005395298A

United States Patent [19]

Moesmann

[11] Patent Number: 5,395,298

[45] Date of Patent: Mar. 7, 1995

[54] FLEXIBLE BAG WITH AN OPENING DEVICE

[76] Inventor: Soren Moesmann, 5, Solstedgårdvej, DK-6240 Logumkloster, Denmark

[21] Appl. No.: 216,614

[22] Filed: Mar. 23, 1994

[30] Foreign Application Priority Data

Mar. 26, 1993 [DK] Denmark ..... 0356/93

[51] Int. Cl.[6] ..... B65D 27/32

[52] U.S. Cl. ..... 383/202; 229/308; 229/87.05

[58] Field of Search ..... 383/200, 202; 229/308, 229/87.05

[56] References Cited

U.S. PATENT DOCUMENTS

| | | | |
|---|---|---|---|
| 1,929,599 | 10/1933 | Millholland | 383/202 X |
| 3,882,999 | 5/1975 | Wellman | 383/202 X |
| 4,265,279 | 5/1981 | Weikert | 383/202 X |
| 5,080,263 | 1/1992 | Johnson | 383/202 X |
| 5,127,065 | 6/1992 | Wade . | |

FOREIGN PATENT DOCUMENTS 3330354 3/1985 Germany .

*Primary Examiner*—Allan N. Shoap
*Assistant Examiner*—Jes F. Pascua
*Attorney, Agent, or Firm*—Flehr, Hohbach, Test, Albritton & Herbert

[57] ABSTRACT

A packaging, preferably a bag of a flexible material, provided with an opening device for facilitating opening of the packaging. The opening device comprises a plate being more brittle and rigid than the packaging material and provided with a transverse weakened line formed of a groove-like portion of reduced plate thickness dividing the member into two halves, each of which may gripped between the thumb and forefinger of a person. The opening device is dimensioned in such a manner in the area of the weakened line that without any difficulty a person can break the device along said line by rotating the two halves towards each other about said line. In close proximity of the groove, a perforation edge is formed in at least one of the halves. The plate member is attached to the packaging with the sharp edge facing the interior of the packaging.

9 Claims, 2 Drawing Sheets

FLEXIBLE BAG WITH AN OPENING DEVICE

BACKGROUND OF THE INVENTION

1. Field of the Invention

The invention relates to a packaging, preferably a bag of a flexible material provided with an opening device for facilitating the opening of said packaging and comprising a plate member being of a brittle material more rigid than the packaging material and provided with a transverse weakened line formed by a groove-like portion of reduced plate thickness dividing the member into two halves, each of which may be gripped between the thumb and forefinger of a person.

2. Background Art

It is commonly known that it can be difficult to open flexible plastics packagings without using a tool, such as a knife or scissors. Moreover, it is known to provide flexible plastics packagings with various means, such as weakened lines, tear strips, etc. to facilitate opening thereof.

Furthermore, U.S. Pat. No. 5,127,065 discloses a packaging and an opening device of the above type formed as a plate member with a slit separating two wing-like members joined at a narrow portion of one end thereof. The plate member is attached to the packaging in proximity to the edges thereof in such a manner that the distal ends of the wings extend beyond the edge of the packaging. The distal ends of the member or wings serve as gripping portions for the thumb and forefinger of the user. By gripping about and thus separating the wings from each other with one hand, the tearing of the bag is facilitated, a larger arm of force being provided than if the bag is grapped directly at the edge.

Moreover, DE-A1-33 30 354 discloses an opening device for plastics bags in form of a plate member intended to be arranged at the corner of the bag. The opening device comprises a transverse groove forming a fracture line. The groove forms a tooth arranged in the plane of the plate member intended for perforating the plastics bag, when the plate member is fractured along the fracture line.

The object of the invention is to provide a packaging of the type stated in the introduction which can be opened without any difficulty and to provide an opening device for obtaining said facilitated opening.

SUMMARY OF THE INVENTION

In satisfaction of the above object, there is provided by the present invention a packaging, said opening device being of a brittle material and dimensioned in such a manner in the area of the weakened line that a person can break the device along said line without any difficulty, wherein in close proximity to the weakened line at least in one of the halves, a perforation means is provided having a sharpe edge directed transversely of the plane of the plate member, and wherein the member is attached to the packaging with the sharp edge facing the interior of the packaging.

When the plate member is fractured along the weakened line by rotating the two halves towards each other, the fracture will be quite abrupt due to the brittleness of the material, whereby the perforation means penetrates the flexible material, from which the packaging is made, and perforates this. Once the material has been perforated, it may be torn easily by gripping about the two halves produced at the fracturing of the opening device and separating the halves from one other.

According to the invention, the opening device may be arranged in close proximity to the periphery of the packaging. This embodiment has in practice proved particularly advantageous for obtaining a controlled opening and tearing of the packaging.

Moreover, according to the invention, the opening device may in its entirety be arranged within the periphery of the packaging. Since the opening device does not extend beyond the periphery of the packaging, the risk is minimized of the device being unintensionally caused to open the packaging during handling and transportation thereof.

The opening device according to the invention is characterised by the features stated in claim 4. When such an opening device is attached to a flexible packaging with the perforation means facing the interior of the packaging, the packaging may be opened easily by means of the manner described above.

According to the invention, the groove may be provided with decreasing width extending from one edge face of the plate member to the opposite edge face thereof.

Furthermore, according to the invention, the groove may be provided with decreasing depth from one edge portion of the plate member to the opposite edge portion thereof.

Moreover, according to the invention, over a portion of its length the groove may be through-going from one surface of the plate member to the other.

Furthermore, according to the invention a transverse indentation may be formed at least on one side of the groove, whereby the perforation means is formed between the groove and the indentation in form of a perforation edge, the lateral walls of the groove and the indentation intersecting at an angle of less than 90°, preferably less than 45°, and most preferred less than 30°.

Finally, according to the invention, the perforation means may comprise at least one tooth-like, sharp projection.

DETAILED DESCRIPTION OF THE PREFERRED EMBODIMENTS

Figure 1:
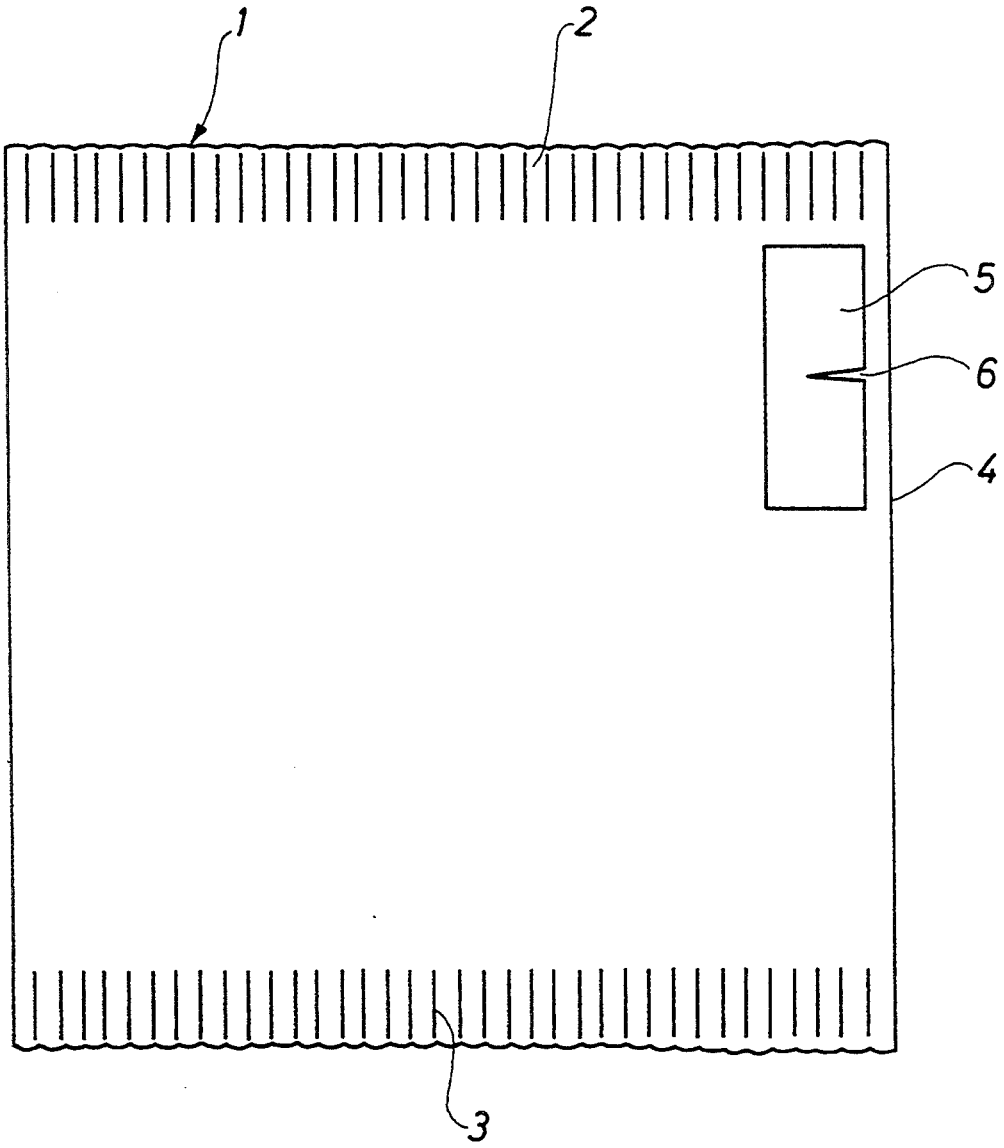
FIG. 1 is a diagrammatic view of a packaging according to the invention in form of a bag provided with an opening device according to the invention.

FIG. 1 illustrates a packing 1 in form of a bag formed of a length of a collapsed plastics hose closed by means of transverse welds 2,3 at the top and bottom. Near the one of the outer side edges 4 of the bag 1, an opening device 5 according to the invention is arranged on the outer face of the bag.

Figure 2:
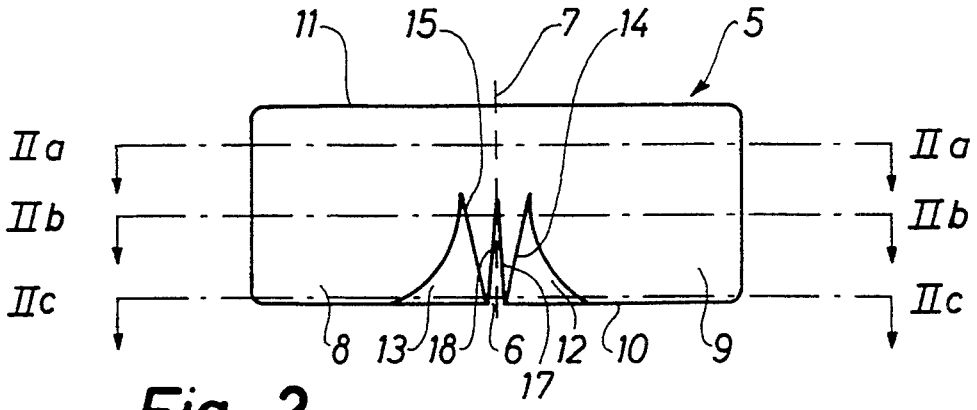
FIG. 2 is a top plan view of the opening device shown in FIG. 1 in enlarged scale.
Figure 2A:
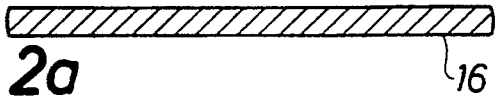
FIG. 2*a* is sectional view along the line IIa—IIa in FIG. 2.
Figure 2B:
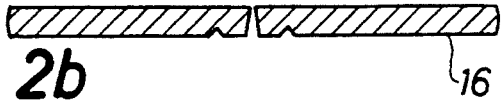
FIG. 2*b* is sectional view along the line IIb—IIb in FIG. 2.
Figure 2C:
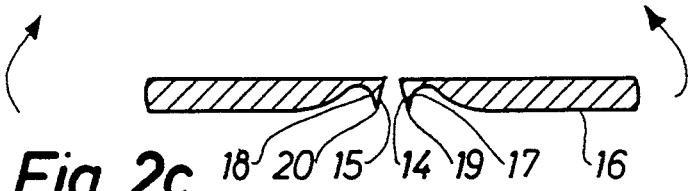
FIG. 2*c* is sectional view along the line IIc—IIc in FIG. 2.

As can be seen in FIG. 2 showing the opening device 5 of FIG. 1 from below, that is in direction from the flexible material of the bag, the opening device is a plate-shaped essentially rectangular member provided with a transverse groove 6 extending over essentially half the width of the member and defining a transverse weakened line 7 dividing the member into two halves 8,9. The width of the groove decreases, when seen in the direction from one edge portion 10 of the plate member to the opposite edge portion 11 thereof.

Furthermore, as it can be clearly seen from FIGS. *2a–2c*, the member is provided with a transverse indentation 12,13 on each side of the groove, the width and depth thereof decreasing from the first edge 10 towards the second edge 11. The lateral walls 17,18 of the transverse indentations being closest to the groove 6 are downwardly inclined towards the lower face 16 of the plate. Correspondingly, the lateral walls defining the groove 6, i.e. the lateral walls 14,15 of the groove, are inclined away from each other in a downward direction. Finally, the lateral walls 14,15 of the groove extend together with the adjacent lateral walls 17,18 of the transverse indentations 12,13 to form a pair of perforation points 19,20 at the first edge portion 10 of the plate member 1. When the plate member is fractured by rotation of the two halves 8,9 about the weakened line 7 in the direction indicated by the arrows in FIG. *2c*, the perforation points 19,20 perforate the subjacent flexible material and thus forming a tear, whereby the bag may be opened easily by moving the two halves 8,9 released from each other in a mutual opposite direction along the weakened line.

Figure 3:
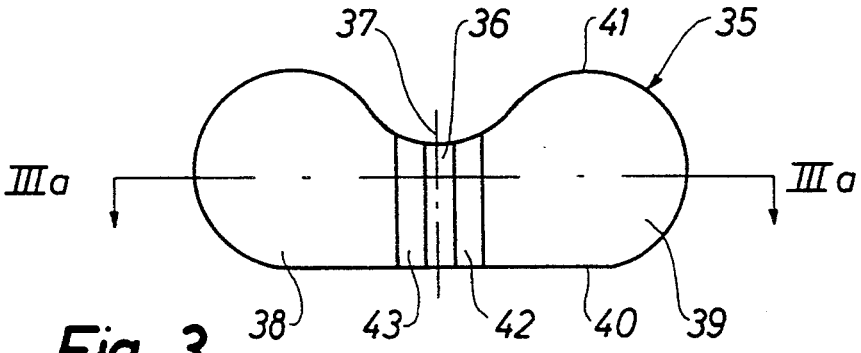
FIG. 3 is a top plan view of another embodiment of the opening device according to the invention.
Figure 3A:
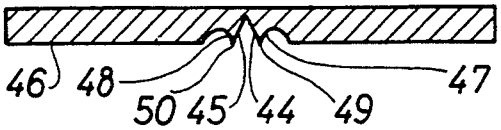
FIG. 3*a* is a sectional view along the line IIIa—IIIa in FIG. 3.

FIGS. 3 and *3a* show an alternative embodiment of an opening device 35 according to the invention formed as an essentially "spectacles-shaped" plate member, when seen from below, i.e. from the packaging, on which it is be arranged. The plate member is provided with a central through-going, V-shaped groove 36 forming a weakened line 37. An essentially U-shaped indentation 42,43 is formed on each side of the weakened line, said indentation also extending transversely of the member in a through-going manner. As a result, on each side of the groove and in transverse direction, a through-going perforating edge 49,50 is formed, at which the lateral walls 44,45 intersect the lateral walls 47,48 of the adjacent transverse indentations 42,43. The perforating edges 49,50 extend beyond the lower face 46 of the member. It is, however, obvious that these also may flush with or be below the lower surface 46 of the member.

The perforating edges 49,50 may be serrated, whereby a plurality of perforation points are produced, when seen transversely.

When the opening device being of a brittle material is fractured along the weakened line, the perforating edges 49,50 perforate the subjacent flexible material, whereby said material may be easily torn open in a manner as described above.

The opening device is preferably of a plastics material rendering a brittle fracture, such as ABS (acrylonitrile butadiene styrene) polycarbonate, acrylic plastics, etc. and is preferably made by injection moulding. Depending on the material of the member and the flexible packaging material, to which the member is attached, the member may be welded or glued thereto. In this connection it should be mentioned that the plate member may be arranged between two laminated layers forming part of the flexible material. The plate member may, depending on the material, typically have a thickness of 0.5 to 2 mm.

Finally, the opening device according to the invention may be provided with a pressure-sensitive adhesive on the lower face, whereby it may be easily attached to the outer face of the packaging.

I claim:

1. A packaging of a flexible material, provided with an opening device for facilitating opening of the packaging and comprising a plate member being of a brittle material more rigid than the packaging material and being provided with a transverse weakened line formed of a groove-like portion of reduced plate thickness dividing the plate member into two halves, each of which may gripped between the thumb and forefinger of a person, said opening device being dimensioned in such a manner in the area of the weakened line that a person can break the device along said line without any difficulty, wherein in close proximity to the weakened line at least in one of the halves, a perforation means is provided having a sharp edge directed transversely of the plane of the plate member, and wherein the member is attached to the packaging with the sharp edge facing the interior of the packaging.

2. A packaging as defined in claim 1, wherein the opening device is arranged in close proximity to the periphery of the packaging.

3. A packaging as defined in claim 1 or 2, wherein the opening device in its entirety is arranged within the periphery of the packaging.

4. An opening device for facilitating opening of a packaging of a flexible material, comprising a plate member being of a brittle material more rigid than the packaging material and being provided with a transverse weakened line formed by a groove-like portion of reduced plate thickness dividing the member into two halves, each of which may be gripped between the thumb and forefinger of a person, said opening device being dimensioned in such a manner in the area of the weakened line that a person can break the device along said line without any difficulty, wherein in close proximity to the weakened line at least in one of the halves, a perforation means is provided having a sharp edge directed transversely of the plane of the plate member.

5. A device as defined in claim 4, wherein the groove is provided with decreasing width from the one edge portion of the plate member to the opposite edge portion thereof.

6. A device ad defined in claim 4, wherein the groove is provided with decreasing depth from one edge portion of the plate member to the opposite edge portion thereof.

7. A device as defined in claim 4, wherein over a portion of its length the groove is through-going from one surface of the plate member to the other.

8. A device as defined in claim 4, wherein a transverse indentation is formed at least on one side of the groove, whereby the perforation means is formed between the groove and the indentation in form of a perforation edge, the lateral walls of the groove and the indentation intersecting at an angle of less than 90°, preferably less than 45°, and most preferred less than 30°.

9. A device as defined in claim 4, wherein the perforation means comprises at least one tooth-like, sharp projection.

* * * * *